US007462328B2

(12) United States Patent
Fritz et al.

(10) Patent No.: US 7,462,328 B2
(45) Date of Patent: Dec. 9, 2008

(54) PIPETTE FOR DISPOSABLE TIPS OF DIFFERENT SIZE

(75) Inventors: Michael Fritz, Biblis (DE); Volker Gerstle, Lorsch (DE); Herbert Harttig, Neustadt (DE); Juergen Schwab, Ketsch (DE)

(73) Assignee: Roche Molecular Systems, Inc., Pleasanton, CA (US)

( * ) Notice: Subject to any disclaimer, the term of this patent is extended or adjusted under 35 U.S.C. 154(b) by 251 days.

(21) Appl. No.: 11/344,349

(22) Filed: Jan. 31, 2006

(65) Prior Publication Data

US 2006/0177345 A1 Aug. 10, 2006

(30) Foreign Application Priority Data

Feb. 4, 2005 (EP) ..... 05100801

(51) Int. Cl.
*B01L 3/02* (2006.01)

(52) U.S. Cl. ..... 422/100

(58) Field of Classification Search ..... 422/100
See application file for complete search history.

(56) References Cited

U.S. PATENT DOCUMENTS

| | | | |
|---|---|---|---|
| 4,151,750 | A | 5/1979 | Suovaniemi et al. |
| 4,283,950 | A | 8/1981 | Tervamaki |
| 6,833,114 | B1 | 12/2004 | Christen et al. |

FOREIGN PATENT DOCUMENTS

| | | | |
|---|---|---|---|
| CH | WO00/69562 | A1 * | 11/2000 |
| DE | 19708151 | A1 | 9/1998 |

OTHER PUBLICATIONS

Search Report for EP Appl No. 05100801.9 filed May 18, 2005, Roche Diagnostics GmbH.

* cited by examiner

*Primary Examiner*—Walter D Griffin
*Assistant Examiner*—Bobby Ramdhanie
(74) *Attorney, Agent, or Firm*—Charles M. Doyle

(57) ABSTRACT

The present invention is directed to a pipette comprising mounting surfaces of different diameters for the use of disposable tips of different size, which permits easy discarding of the tips after use. Such pipettes can be used in manual and automatic pipetting systems.

6 Claims, 3 Drawing Sheets

PIPETTE FOR DISPOSABLE TIPS OF DIFFERENT SIZE

This application claims the benefit of priority under 35 U.S.C. §119 of EP Application 05100801.9 filed Feb. 4, 2005, the contents of which are hereby incorporated by reference.

FIELD OF THE INVENTION

The present invention is directed to pipetting devices for dispensing defined volumes of liquids.

BACKGROUND OF THE INVENTION

Pipetting devices are widely used for dispensing defined volumes of liquids, especially in the range of around twenty milliliters down to picoliters. They are standard equipment in laboratories and widely used for example in the field of chemistry, biology, medicine and diagnostic. Depending on the concrete purpose different types of pipettes are known.

Glass pipettes in which the liquid is pipetted by mouth have been used in the past. Nowadays manual pipetting devices are used, which are for example commercially available from Eppendorf and Gilson. These can be single channel devices, but also multichannel pipettes are used allowing transferring several liquids at once. Most of these manual devices comprise a handle, a lower part used to transfer the liquids, a shaft connecting the handle with said lower part. In case a pipette allows to adjust the volume of liquid these pipettes also have means for adjusting the volume, for example by thumb wheels integrated into the handle. They also have means for generation of a vacuum allowing sucking the desired volume of liquid into the pipette, frequently this is a movable piston in a cylinder integrated in the pipette which can be moved by a push-down button at the upper part of the pipette.

As contaminations between samples or reagents are not desirable, many of these pipettes are used in conjunction with disposable tips. These tips are attached to a mounting surface at the lower end of the pipette and are discarded after use. The Pipette itself usually has no direct contact with the liquid. To simplify ejection of the tips several means are used by pipettes known in the art. Usually such ejectors are means which slip off the tip by applying pressure to the upper edge of the tip and which are connected to a push-down button at the upper side of the pipette.

Beside manual pipettes also automated pipettes are known. In the field of Chemistry, Biology and Medicine for example automated devices are used for sample preparation and diagnostic assays, which in most cases also have automated pipettes included. These pipettes either use tips which can be easily washed after use or which use disposable tips similar to those used by the manual devices described above.

Depending on the volume, which should be dispensed, the size of the disposable tips varies. Consequently, different pipettes having mounting surfaces of different diameters for the different tips are used. Whereas this might be acceptable when conducting manual experiments or assays, the need to use separate pipettes for disposable tips of different size represents a significant disadvantage for automated systems.

In U.S. Pat. No. 4,593,837 a pipette is described which has different mounting surfaces for mounting tips of different size. However, no means are described for this pipette which allows discarding the tips after use.

Thus, it was an object of the present invention to provide an improved pipetting device allowing the use of differently-sized tips, especially a device which allows to easily discarding the disposable tips after use.

SUMMARY OF THE INVENTION

One aspect of the present invention is directed to a device for dispensing liquids having at least two surfaces for mounting of disposable tips, whereby said both mounting surfaces have a different outer diameter and are movable against each other allowing to discard a disposable tip being mounted onto the mounting surface having the smaller diameter by moving the mounting surface having the wider diameter against said disposable tip.

Another aspect of the present invention is directed to a method for mounting a disposable tip comprising:

- mounting a disposable tip onto one of the mounting surfaces of the above device, and
- ejecting said disposable tip.

Another aspect of the present invention is directed to a method for dispensing liquid comprising:

- mounting a disposable tip onto one of the mounting surfaces of the above device,
- aspirating the disposable tip with a defined volume of liquid,
- dispensing said liquid, and
- ejecting said disposable tip.

A further aspect of the present invention is directed to the use of a device as described above for manually dispensing liquids or, even more preferably, the use of such devices in automated dispensing systems.

DETAILED DESCRIPTION OF THE INVENTION

The present invention is directed to a device for dispensing liquids. In order to avoid contaminations, the devices have mounting surfaces to mount disposable tips thereto. The liquids only have contact to the surface of these tips. Depending on the volume of liquid which should be pipetted, the size of the tip, especially its inner diameter varies. For example tips used for pipetting 1 ml are not suitable to pipet volumes in the range of 1 to 10 μl. To allow the use of differently sized tips for pipetting different volumes of liquid with only one pipette, the device of the present invention has at least two mounting surfaces of different outer diameter, which are oriented in a staggered fashion along the axis of the pipette and which mounting surfaces are movable against each other. After use, the tips can be discarded by moving the mounting surface having the wider diameter downwards (vertical along the axis of the pipette) and applying pressure to the tip mounted onto the mounting surface having the smaller diameter and slipping the tip off from the mounting surface. If a higher volume needs to be pipetted, a tip can be mounted onto the mounting surface having the wider outer diameter. After use, this bigger tip can be discarded either by a further mounting surface having an even wider outer diameter than the two before mentioned mounting surfaces, or by a separate ejector, for example a movable case having a wider diameter than the mounting surfaces or any other means known in the art.

Figure 1:
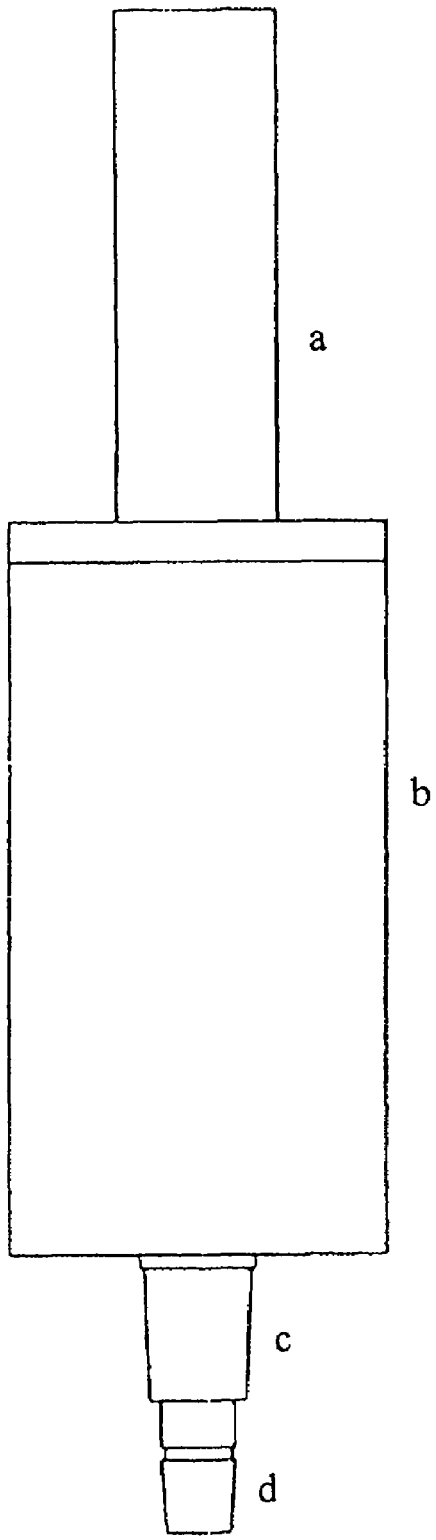
FIG. 1 shows a device according to the present invention (a, shaft connecting tip holder with the pumping system; b, case for ejecting disposable tips; c, mounting surface having wider diameter for connecting tips with pipette and d, mounting surface having smaller diameter).
Figure 2:
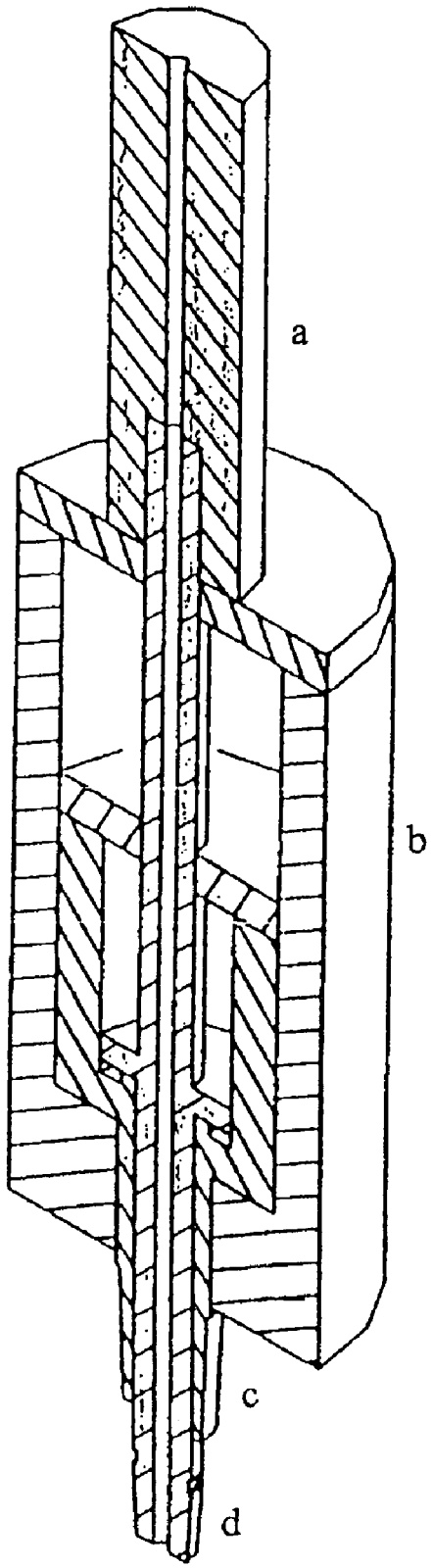
FIG. 2 shows a cross-section of a device according to the present invention (a to d as described above).
Figure 3:
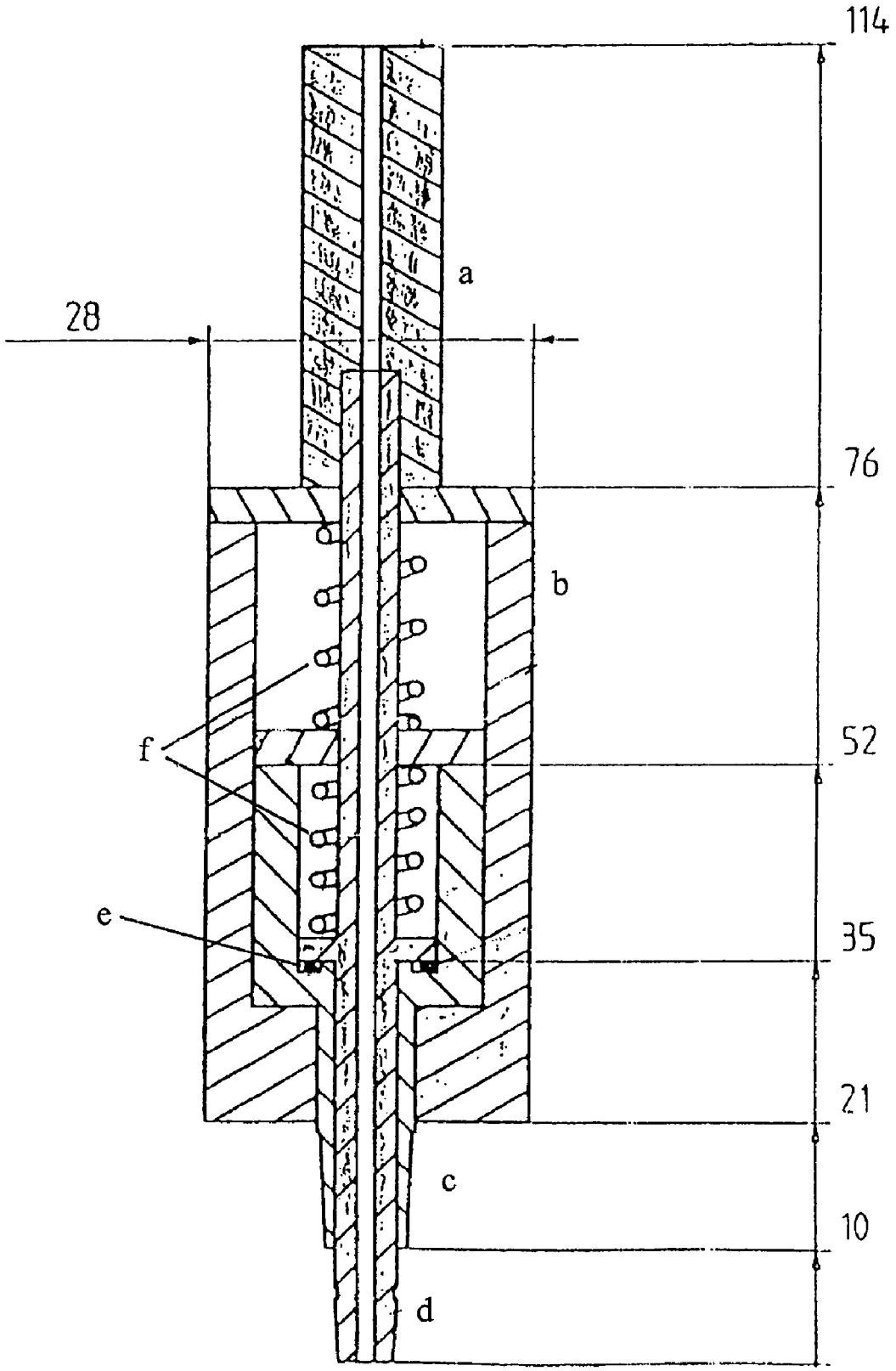
FIG. 3 shows a detailed cross-section of a device according to the present invention (dimensions are indicated in millimeters; a to d as described above; e, sealing and f, springs).

Preferably, the mounting surfaces are cylindric tubes of different diameters, which are fitted into each other as shown in FIG. 1 to 3. These cylinders can be moved against each other by manual power or in automated systems preferably by pneumatic, electric means or other means known in the art.

The movement of the mounting surfaces and optionally also that of a separate ejector as described above can be coordinated in different ways. The mounting surfaces to be used as ejectors and optionally also the separate ejector could be linked together, for example by a suitable linkage or an electronic control. In such a device all mounting surfaces (except for the mounting surface having the smallest diameter, which cannot be used for ejecting tips), and optionally also the separate ejector would be consecutively moved downwards if a disposable tip should be ejected from any one of the mounting surfaces of this device. Alternatively, each mounting surface and optionally also a separate ejector can be moved separately independently from the other. As such a device would need separate construction means like for example linkages, push-down-buttons (in case it is a manual pipette), control means and so on for each of the mounting surfaces and preferably also for the separate ejector, such a device would be more complex than the first alternative.

Preferably, the device allows to put the mounting surfaces and optionally also a separate ejector in a temporally fixed position when they are not needed for ejecting a disposable tip. This can be achieved by integrating for example springs in a device as shown in FIG. 3, *f*, which avoid that the mounting surfaces and optionally also a separate ejectors move downwards without intention. But also other means are known in the art and can be used for this purpose.

The defined volume of liquid is filled into the tips by applying a defined vacuum to the inner volume of the tip and the liquid can be sucked into the inner volume. Similar to standard pipettes known in the art, this suction can be generated by a piston connected to the tip by an airtight channel or by other means known in the art. For manual use, the pipetting device could be made similar to the pipettes described for example in US 2003/0156994 or U.S. Pat. No. 5,364,595, whereby the lower part of the pipettes, which are used for mounting of the tips, would be constructed as described above. For example, a manual pipette could comprise a handle, means for adjusting the volume to be pipetted, means like push-down buttons for moving the mounting surfaces to eject the tips after use, a shaft connecting the upper part of the pipette with the lower part comprising the movable mounting surfaces as described above and, optionally a further ejector for ejecting tips mounted onto the mounting surface having the widest diameter.

This concept could also be used for pipettes used in automated devices for synthesis of chemical and biological compounds, sample preparation or medical and molecular diagnostic methods. Pipettes used in such instruments usually contain means for generation of a defined vacuum necessary to suck a defined volume of liquid into the tip, means to control the generation of this vacuum, a lower part of the pipette for mounting the disposable tips onto, which would be organized according to the present invention (see above). Of course, the connecting channel from the mounting surfaces up to the means for generation of the vacuum needs to be airtight in order to not provoke leakage of the pipette. As for the manual handheld pipettes described, also automated pipettes could have a separate ejector for ejecting the tips fitted onto the mounting surface having the widest outer diameter. Such an ejector could be either a case as shown in FIG. 1 to 3, but could also be an ejector known from standard pipettes, like the pipette commercially available from Gilson and Eppendorf, or any other ejector known in the art.

The mounting surfaces are situated at the lower end of the pipettes. If not indicated otherwise the diameter of a mounting surface refers to the outer diameter of this mounting surface at the position which do have direct contact with the disposable tip. The shape of the mounting surfaces is adapted to the shape of the inner surface of the upper part of the disposable tips to be used. Usually, tips are being used having a circular opening at the top and a second smaller opening at the bottom which second opening is used to suck the liquid into the tip and for dispensing the liquid. Using these tips, the mounting surface has a cylindric shape of the same outer diameter than the opening at the top of the tip. Most often this cylinder is slightly conical along the axis of the device (as shown in FIG. 1 to 3) in order to promote a good and airtight contact with the tips and to counterbalance slight variations between the tips used.

The mounting surfaces can be made of the same material as the pipette, but might be also made of different material. Commonly pipettes in the art are made of elastic-flexible plastic materials like thermoplastic. Similar to standard pipettes known in the art, it is also important for the pipettes according to the present invention that the part connected to the disposable tips provides a good and airtight contact to the tips and has a robust and inert surface.

The at least two mounting surfaces are preferably orientated as interleaved or telescoped cylinders as shown in FIG. 1 to 3. The movement of the mounting surfaces against the axis of the pipette can be promoted either by hand, for example using a push-down button, or automatically for example by electric or pneumatic force. As described above, the mounting surface having the wider diameter can be used to discard disposable tips mounted onto the surface having the smaller diameter. Therefore, pipettes as shown in FIG. 1 to 3 allow using the pipette with disposable tips having two different sizes and diameters of the upper opening of these tips. By adding a further mounting surface having an even wider diameter, such a pipette could also be used with tips of a greater size. Of course, further mounting surfaces can be added if needed.

In order to ease ejecting of tips mounted onto the mounting surface having the widest diameter pipettes according to the present invention preferably also have an ejector for this purpose. Such an ejector can be a cylindrical case having a wider diameter than the mounting surface having the widest diameter, which is situated above this mounting surface and can be vertically moved against the tip being attached to the mounting surface. As shown in FIG. 1 to 3, such a construction allows ejecting the tip mounted onto this surface by moving the ejector case downwards and pulling down the tip being mounted onto the mounting surface.

A further aspect of the invention is directed to the use of the before described pipettes for manually dispensing liquids. If the described invention is adapted in automated pipettes, these pipettes can also be used in automated devices, like devices for automatically synthesis of organic and biological substances, devices for sample preparation and devices for conducting diagnostic methods. Such pipettes do comprise automation means for example controlling means such as electronic controls to control suction and dispensing of liquids and also the process of mounting and ejecting of the tips and for example motors or pneumatic devices for moving of the mounting surfaces, separate ejector and pumping system.

Frequently such pipettes are not in a fixed position, but are constructed to allow moving the pipette within the instrument.

Another aspect of the present invention is directed to a method for mounting a disposable tip comprising:

mounting a disposable tip onto one of the mounting surfaces of a device, and ejecting said disposable tip, whereby said device comprises at least two surfaces for mounting of disposable tips, whereby said both mounting surfaces have a different diameter and are movable against each other allowing to eject a disposable tip being mounted onto the mounting surface having the smaller diameter by moving the mounting surface having the wider diameter against the edge of said disposable tip.

Preferably, the present invention is directed to methods for dispensing liquids comprising:

mounting a disposable tip onto the mounting surface of a pipetting device;

aspirating said disposable tip with a defined volume of liquid;

dispensing said volume of liquid; and ejecting said disposable tip, wherein said pipetting device comprises at least two surfaces for mounting of disposable tips, whereby said both mounting surfaces have a different diameter and are movable against each other allowing to eject a disposable tip being mounted onto the mounting surface having the smaller diameter by moving the mounting surface having the wider diameter against said disposable tip.

Preferably, a tip being mounted onto the mounting surface having the widest diameter is ejected by a separate ejector present in the pipetting device for this purpose (as described above).

EXAMPLES

Example 1

As discussed above, the pipetting devices according to the present invention are especially suited for automated systems, in which pipetting steps are made in an automated fashion. The present invention allows using only one pipettor within such an automated device together with pipette tips of different size, and therefore, reduces the costs and complexity of such devices. In FIG. 1 to FIG. 3 the lower part of such a pipetting device is shown which comprises two mounting surfaces. This allows using this device with tips of two different sizes. Most of the remaining parts of the pipetting device such as means for aspirating and dispensing the liquids (like a vacuum device) and controlling units are not shown in these figures, but can be constructed as known in the art. Such a pipetting device can be integrated in an instrument for automatically conducting for example biological, biochemical, medical and diagnostic methods. The part of the pipetting device as shown in FIG. 1 to FIG. 3 can be mounted onto a movable arm, which allows moving the pipettor within an automated instrument.

FIG. 1 shows a scheme of a pipetting device of the present invention. The two mounting surfaces (c and d) allow to use disposable tips of two different sizes with the pipetting device. A tip mounted onto mounting surface (d) can be ejected after use by vertically moving mounting surface (c) against the upper edge of the tip and slipping it off from mounting surface (d). A bigger tip can be mounted onto mounting surface (c). After use the ejector (b) can be vertically moved against the tip and slipping it off from the mounting surface (c). This ejector is constructed as a case having a wider diameter than mounting surface (c). The mounting surfaces and the ejector are constructed as interleaved cylinders which can be vertically moved against each other (see FIGS. 2 and 3). The vacuum needed to suck a defined volume of liquid into the tip and positive pressure to dispense the liquid can be generated by means known in the art. This can be for example a piston which can be moved in a cylinder. The vacuum and positive pressure can be transferred to the tip through an airtight channel as shown in FIGS. 2 and 3. In order to avoid leakage within the channel sealings are preferably integrated between the movable parts like the mounting surfaces and ejector (see FIG. 3, *e*). Springs as shown in FIG. 3, *f* can be used to fix the movable parts (mounting surfaces and ejector) within a defined position, but also other means known in the art can be used. The mounting surface (c) and ejector (b) can be moved downwards to eject the disposable tips after use by using a linkage (not shown in the Figures). The linkage can be driven by means known in the art. In an automated pipetting device this could be for example done by an electric motor controlled by an electronic control such as a computer.

While the foregoing invention has been described in some detail for purposes of clarity and understanding, it will be clear to one skilled in the art from a reading of this disclosure that various changes in form and detail can be made without departing from the true scope of the invention. For example, all the techniques and apparatus described above can be used in various combinations. All publications, patents, patent applications, and/or other documents cited in this application are incorporated by reference in their entirety for all purposes to the same extent as if each individual publication, patent, patent application, and/or other document were individually indicated to be incorporated by reference for all purposes.

The invention claimed is:

1. Pipetting device for dispensing liquids comprising at least two surfaces for mounting of disposable tips, whereby said both mounting surfaces have a different diameter and are movable against each other allowing to discard a disposable tip being mounted onto the mounting surface having the smaller diameter by moving the mounting surface having the wider diameter against said disposable tip said pipetting device further comprising an ejector allowing to eject disposable tips mounted onto the mounting surface having the widest diameter.

2. Device according to claim 1, wherein said ejector is a movable case having a wider diameter than said mounting surface having the widest diameter.

3. Device according to claim 1, wherein said device is a handheld manual pipetting device.

4. Device according to claim 1, wherein said device comprises means allowing automatic pipetting steps.

5. A method for mounting and ejecting disposable tips comprising:

mounting a disposable tip onto one of the mounting surfaces of a device according to claim 1, and ejecting said disposable tip.

6. A method for dispensing liquids comprising:

mounting a disposable tip onto one of the mounting surfaces of a device according to claim 1, aspirating said disposable tip with a defined volume of liquid, dispensing said liquid, and ejecting said disposable tip.

* * * * *